United States Patent [19]

Bowden, Jr. et al.

[11] Patent Number: 4,775,332

[45] Date of Patent: Oct. 4, 1988

[54] ELECTRICAL RECEPTACLE

[75] Inventors: Wade R. Bowden, Jr., Northport; David Herzfeld, Hicksville, both of N.Y.

[73] Assignee: Slater Electric, Inc., Glen Cove, N.Y.

[21] Appl. No.: 10,334

[22] Filed: Feb. 3, 1987

Related U.S. Application Data

[63] Continuation of Ser. No. 694,268, Jan. 24, 1985, abandoned.

[51] Int. Cl.[4] ..... H01R 13/11

[52] U.S. Cl. ..... 439/650; 439/857

[58] Field of Search ..... 339/191 R, 191 M, 191 S, 339/192 R, 192 RL, 95 D, 278 C; 439/650, 682–691, 856, 857

[56] References Cited

U.S. PATENT DOCUMENTS

| | | | |
|---|---|---|---|
| 1,410,651 | 3/1922 | Caps | 339/191 R |
| 1,698,449 | 3/1928 | Petersen | 339/191 R |
| 2,205,186 | 6/1940 | Andre | 339/191 R |
| 2,214,065 | 9/1940 | Pennock et al. | 439/516 |
| 2,575,161 | 11/1951 | Deakin | 439/857 |
| 2,705,785 | 4/1955 | Benander | 339/95 D |
| 2,946,977 | 7/1960 | Sheldon | 339/191 R |
| 2,965,869 | 12/1960 | Ludwig | 339/95 D |
| 3,003,133 | 10/1961 | Herman et al. | 339/191 R |
| 3,315,218 | 4/1967 | Aker | 339/191 R |
| 3,516,048 | 6/1970 | Scheingold et al. | 29/874 |
| 3,663,931 | 5/1972 | Brown | 439/857 |
| 4,342,495 | 8/1982 | Bennett et al. | 439/654 |
| 4,508,401 | 4/1985 | Casciotti et al. | 339/95 D |

*Primary Examiner*—Neil Abrams

*Attorney, Agent, or Firm*—Morgan & Finnegan

[57] ABSTRACT

In a high grade electrical receptacle, the terminals are fabricated from a low strength alloy such as cartridge brass. The terminals include a pair of grasping members which extend from a common member and which are inclined toward one another to grasp the blade of an electrical plug. The grasping members are tapered by having decreasing cross sectional dimensions as they extend from the common member. In one embodiment of the invention the inclined grasping members are generally rectangular with a generally triangular cut out. In an alternate embodiment of the invention, the grasping members are of a generally triangular shape.

4 Claims, 3 Drawing Sheets

ELECTRICAL RECEPTACLE

This is a continuation of co-pending application Ser. No. 694,268, filed on Jan. 24, 1985, now abandoned.

BACKGROUND OF THE INVENTION

1. Field of the Invention

The present invention relates generally to electrical receptacles and more specifically to a high grade electrical receptacle utilizing terminals fabricated from ordinary brass.

2. Description of the Prior Art

High grade electrical receptacles are specially designed electrical receptacles that are used in hospitals or that meet demanding federal specifications. High grade electrical receptacles are generally similar to ordinary residential use electrical receptacles except that the terminals are fabricated from high strength copper alloys instead of ordinary copper alloys such as 70/30 (70% copper, 30% zinc) cartridge brass. For example, a manufacturer of electrical receptacles may have to use CDA (Copper Development Association's) No. 688 copper alloy instead of ordinary 70/30 cartridge copper to make a high grade receptacle which will pass U.L. (Underwriters Laboratories) Standards or Federal specification standards.

CDA No. 688 alloy is a relatively expensive copper alloy which has a tensile strength of 109 kips and an IACS conductivity of 18%. On the other hand, 70/30 cartridge brass is relatively inexpensive, has a better conductivity of 28%, but a lower tensile strength of 76 kips Manufacturers must use the higher strength alloys such as CDA No. 688, because terminals made of lower strength alloys, such as cartridge brass can become overstressed and will fail to secure adequately an electrical plug which is inserted therein. Such a failure is intolerable in a hospital emergency room or other demanding location.

Federal specifications require testing to determine whether an electrical receptacle can be considered a high grade receptacle. The test consists of taking a maximum thickness electrical plug blade having a thickness of 0.075" and inserting it into the electrical receptacle twenty times. A minimum thickness electrical plug blade having a thickness of 0.055"is then attached to a weight of 1.5 pounds and is inserted into the electrical receptacle. The electrical receptacle is held in a horizontal position face down with the 1.5 pound weight suspended in mid-air. The electrical receptacle must hold the weight for at least one minute for the electrical receptacle to pass federal specification requirements.

Prior art electrical receptacles having their terminals fabricated from ordinary copper alloys, such as cartridge brass, cannot pass the U.L. test, since the terminals become overstressed when the thick 0.075" blade is repeatedly inserted into the terminals. Accordingly, a novel design high grade electrical receptacle having its terminals fabricated from a relatively low strength copper alloy would have a decreased cost and improved conductivity.

SUMMARY OF THE INVENTION

The apparatus of the present invention provides a high grade electrical receptacle having terminals fabricated from a relatively low cost, low strength copper alloy. The electrical receptacle includes a face cover and a body which is attached to a mounting strap. Disposed within the electrical receptacle body are a plurality of terminals which are connected to power lines. The terminals also include grasping members which are capable of receiving the blades of an electrical plug. The grasping members are extended from a common member and inclined towards one another. They preferably have counter-inclining edges which form a V-shaped opening therebetween. When the blades of the electrical plug are inserted into the electrical receptacle they are held between the grasping members. The inclined grasping members are tapered by having decreasing cross section dimensions as they extend from the common member. In one embodiment of the invention, the inclined portions of the grasping members are generally rectangular with a substantially triangular cut out. In an alternate embodiment of the invention the inclined portions of the grasping members are substantially triangular shaped with the base of the triangle adjacent to the common member.

DETAILED DESCRIPTION OF THE INVENTION

Figure 1:
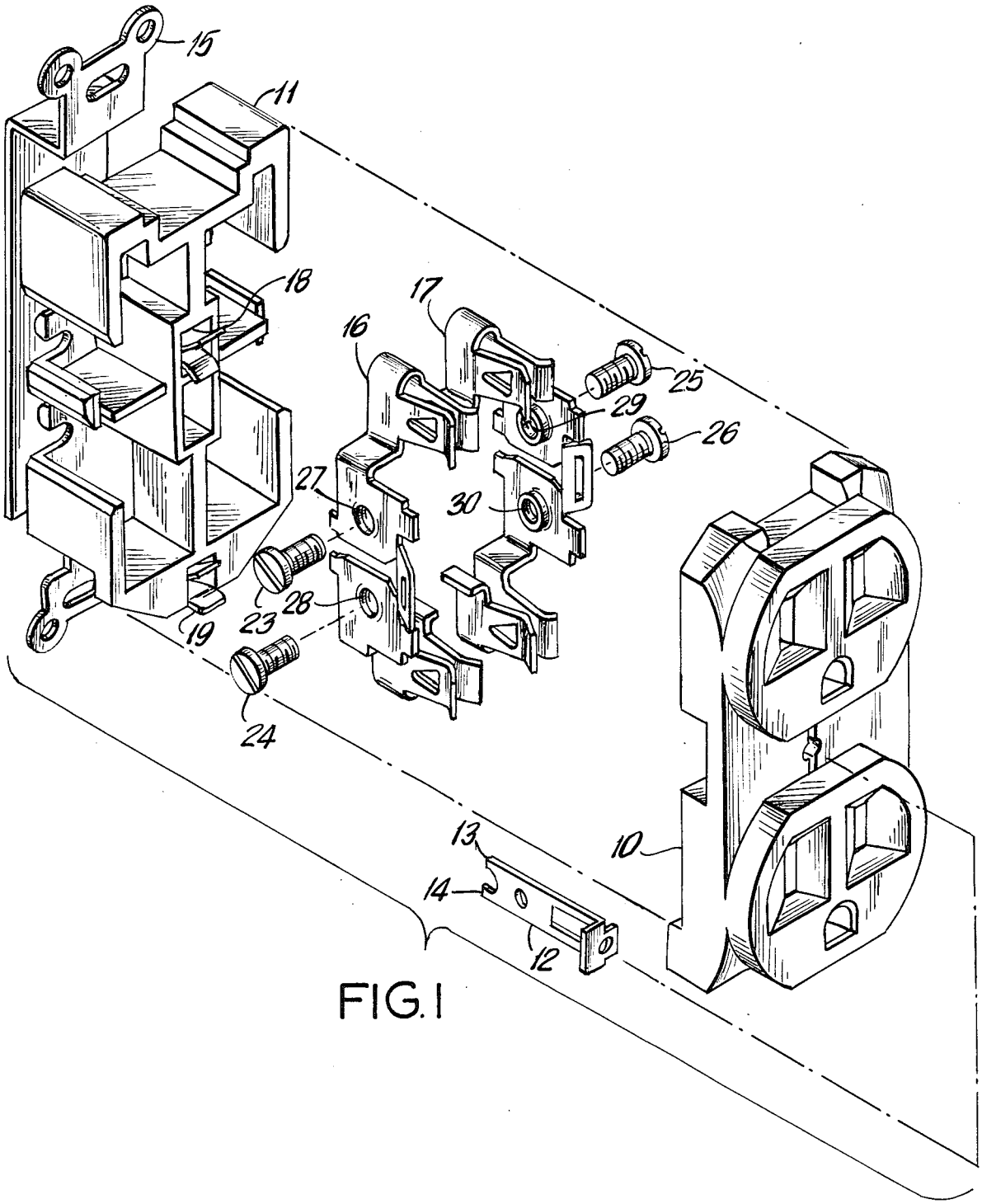
FIG. 1 is an exploded perspective view of the electrical receptacle of the present invention.

Referring now to FIG. 1, the high grade electrical receptacle of the present invention is illustrated in an exploded view. The electrical receptacle includes a face cover 10 which encloses a body 11. The face cover 10 is secured to the body 11 by a bracket 12 which extends through the face cover and body and passes through a mounting strap 15. The ends 13, 14 of the bracket 12 are bent in opposite directions to secure the entire assembly.

Within the body 11 a pair of novel terminals 16, 17 are disposed. The terminals 16, 17 are hereinafter described in greater detail. Power lines are connected to the terminals 16, 17 by screws 23–26 which are threaded into holes 27–30. The power lines could alternatively be connected to the terminals 16, 17 by back wiring methods which are well known to those skilled in the art. Within the body 11 a pair of brass clips 18, 19 cooperate with the ground blade of an inserted electrical plug to provide a conductive path to the mounting strap 15, thereby grounding the plug.

Figure 2:
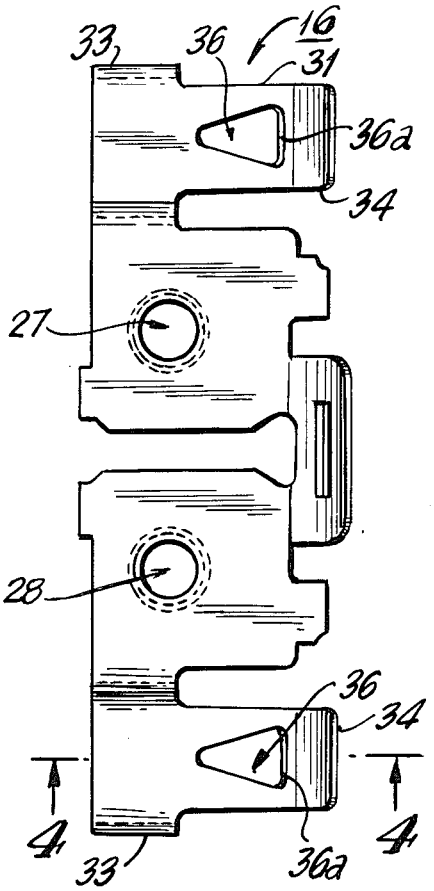
FIG. 2 is front view of the terminal illustrated in FIG. 1.
Figure 3:
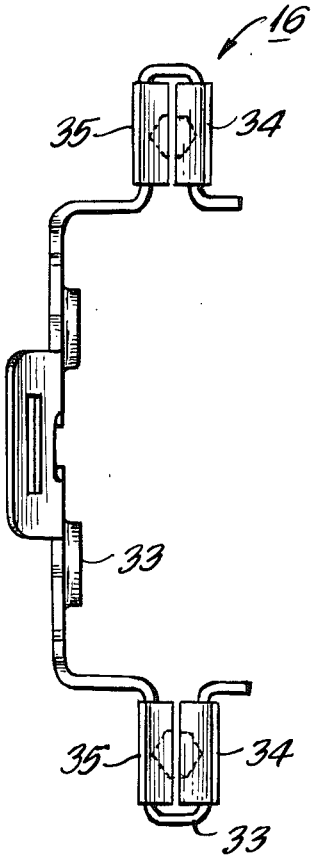
FIG. 3 is a plan view of the terminal of FIG. 2.
Figure 4:
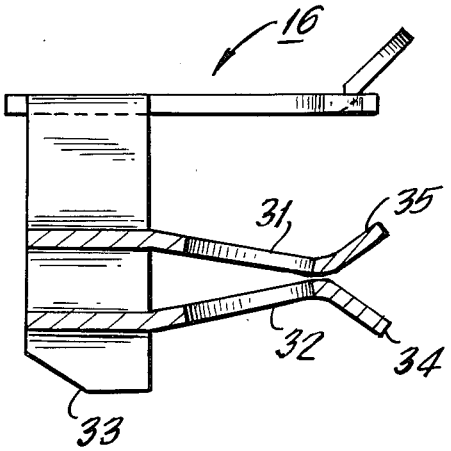
FIG. 4 is a cross sectional side view of the terminal of FIG. 2.

Referring now to FIGS. 2, 3 and 4 enlarged front, plan, and cross sectional side views of the novel terminal 16 are provided. The terminal 16 is preferably fabricated from CDA No. 260 brass which is commonly referred to as "cartridge brass". The terminal 16 includes two pairs of grasping members 31, 32 which extend from a common member 33 at an inclined angle. The inclined grasping members 31, 32 also have counter-inclined edges 34, 35 which form a V-shaped opening to receive an electrical plug blade. When the electrical plug blade is inserted into the terminal 16, the blade is held firmly between the grasping members 31, 32. The cross sectional dimensions of the inclined grasping member 31, 32 decrease as the grasping members extend from the common member 33. This tapered effect is achieved by placing a triangular cut out 36 in the grasping members 31, 32. The triangular cut outs 36 have their bases 36*a* located distant from the common member 33 and adjacent to the counter-inclined edges 34, 35.

The cut outs 36 provide the grasping members 31, 32 with less brass as they extend from the common member 33. By tapering the grasping members 31, 32 in this fashion, they are more flexible over their entire length. This increased flexibility enables the grasping members 31, 32 to be spread apart by an inserted electrical receptacle blade without reaching their yield points.

If the grasping members 31, 32 are not tapered and are of a uniform cross sectional dimension as in the prior art, relatively low strength cartridge brass cannot be used, because a relatively large stress would be applied at the joints between the grasping members 31, 32 and the common member 33. The relatively large stress would cause the grasping members 31, 32 to exceed their yield point and be permanently deformed.

In the present invention, however, the grasping members 31, 32 are tapered giving them increased flexibility. This increased flexibility prevents the grasping members 31, 32 from exceeding their yield points and allows them to be fabricated from the lower cost and lower strength cartridge brass. Accordingly, it is possible using the present invention to make an electrical receptable having ordinary cartridge brass terminals that will pass the U.L test and also meet federal specifications.

Figure 5:
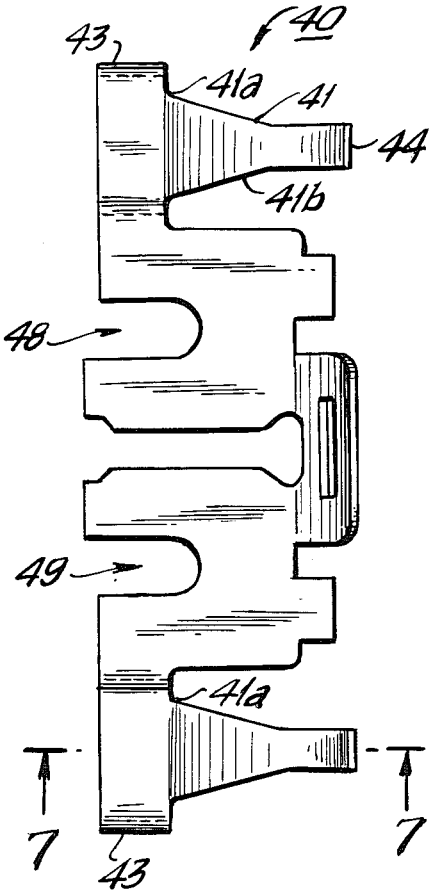
FIG. 5 is a front view of an alternate embodiment of the terminal of FIG. 2.
Figure 6:
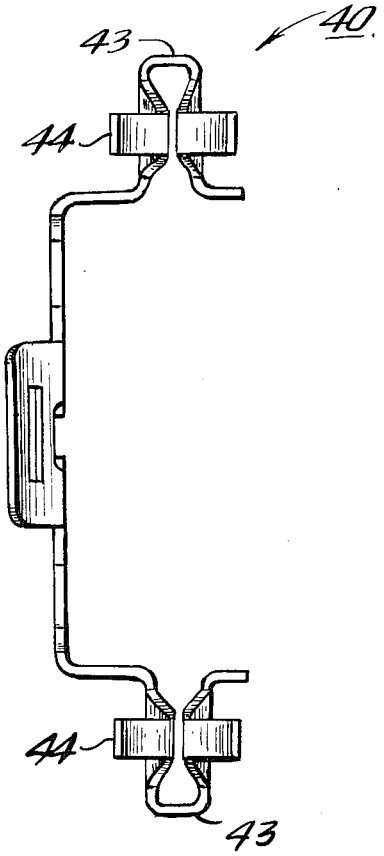
FIG. 6 is a plan view of the terminal of FIG. 5.
Figure 7:
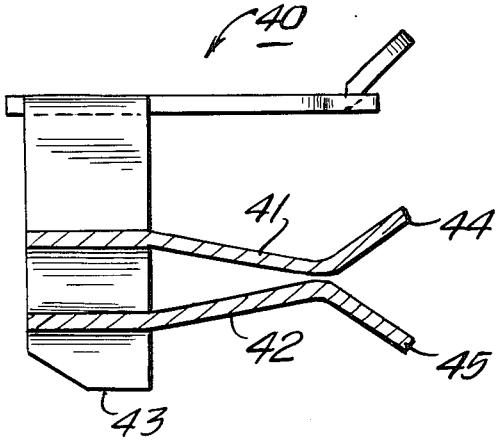
FIG. 7 is a cross sectional side view of the terminal of FIG. 5.

Referring now to FIGS. 5, 6 and 7, front, plan, and cross sectional side views of an alternate embodiment of a terminal 40 utilizing the present invention are provided. The terminal 40 is functionally equivalent to the terminal 16 described above except that it has apertures 48, 49 which make it suitable for back wiring methods mentioned above. Threaded holes, like the holes 27–30 in terminal 16, could be substituted for the apertures 48, 49. Like terminal 16 the terminal 40 has inclined grasping members 41, 42 which extend from a common member 43. The grasping members 41, 42 also have cross sectional dimensions which decrease as they extend from the common member 43. This tapered effect is achieved in terminal 40 by using grasping members 41, 42 which have a generally triangular shape. The base 41*a* of the generally triangular shape is adjacent to the common member 43. At the tops 41*b* of the generally triangular shapes, there are counter-inclined edges 44, 45 which are well adapted for receiving the blades of an electrical plug.

While the invention has been described in its preferred embodiments, it is to be understood that the words which have been used are words of description, rather than limitation, and that changes may be made within the purview of the appended claims without departing from the true scope and spirit of the invention in its broader aspects.

We claim:

1. An improved electrical receptacle of the type having a face cover and a body with a plurality of terminals therein for receiving plug blades along an axis of insertion, wherein the improvement comprises a terminal having at least two grasping members which are extended from a common member towards one another to receive a plug blade therebetween, each of said grasping members having an inclined portion which is inclined toward said axis and an edge which is counter-inclined thereto to extend away from said axis, wherein said inclined portion is adapted to receive stress from said blade, the inclined portion of said grasping members being of a substantially continuously decreasing cross-sectional dimension as said grasping members extend from the common member thereby adapting said grasping members to uniformly distribute said stress along said inclined portions, and wherein said inclined portions of said grasping members are of substantially rectangular shape having a cut out which is substantially triangular and configured to achieve a continual reduction in cross sectional area of the inclined portions from the common members to the grasping area thereby adapting said grasping members to uniformly distribute said stress along said inclined portions.

2. An electrical receptacle according to claim 1 wherein said grasping members include counter-inclined edges.

3. An electrical receptacle according to claim 1 wherein said terminal is made from a low cost copper alloy such as an alloy containing approximately 70% copper and 30% zinc.

4. An electrical receptacle according to claim 1 wherein the said cut out portion of the inclined portions of the terminals reduces the stress levels of the metal by controlling and distributing the bend arc to stay below the yield point of the metal.

* * * * *